US005228480A

United States Patent [19]

Tamura

[11] Patent Number: 5,228,480

[45] Date of Patent: Jul. 20, 1993

[54] PICK FINDING APPARATUS FOR ELECTRIC MOTOR DRIVEN HEALD FRAMES

[75] Inventor: Zenji Tamura, Kanazawa, Japan

[73] Assignee: Tsudakoma Kogyo Kabushiki Kaisha, Kanazawa, Japan

[21] Appl. No.: 882,590

[22] Filed: May 13, 1992

[30] Foreign Application Priority Data

May 13, 1991 [JP] Japan ..... 3-107329

[51] Int. Cl.[5] ..... D03D 51/00

[52] U.S. Cl. ..... 139/1 E; 139/55.1; 139/116.2; 139/1 R

[58] Field of Search ..... 139/116.2, 1 E, 79, 139/1 R, 55.1, 116.1; 318/163, 164

[56] References Cited

U.S. PATENT DOCUMENTS 3,557,842 1/1971 Porter ..... 139/79 X
3,680,602 8/1972 Hindle et al. ..... 139/1 E X
4,724,872 2/1988 Speich ..... 139/1 E

FOREIGN PATENT DOCUMENTS 0067250 12/1982 European Pat. Off. .
8710997 1/1983 Fed. Rep. of Germany .
3225819 1/1984 Fed. Rep. of Germany .
2445401 7/1980 France .
63-58940 11/1988 Japan .
3-185147 8/1991 Japan ..... 139/1 R

*Primary Examiner*—Andrew M. Falik
*Attorney, Agent, or Firm*—Oblon, Spivak, McClelland, Maier & Neustadt

[57] ABSTRACT

A shedding controlling apparatus for a loom wherein each of a plurality of heald frames is driven by a drive motor for the exclusive use therefor. During steady operation of the loom, when a crank angle is inputted to a position instructing section, the position instructing section produces an aimed amount of rotation, and a position controlling section controls the drive motor to rotate in accordance with the aimed amount of rotation to eliminate a deviation thereof from a crank shaft of the loom to establish a synchronized relationship between them. Then, when an operation instruction signal is generated during stopping of the loom, a movement instructing advice drives the drive motor by a predetermined amount of rotation by way of an OR gate and the position controlling section in accordance with a shedding pattern designated by way of a shedding instructing and shedding pattern instructing so that a leveling operation of the heald frame, a pick finding operation and a starting preparing operation may be performed automatically.

7 Claims, 5 Drawing Sheets

Fig. 4

| OPERATION INSTRUCTION SIGNAL ($S_5$) | INSTRUCTION CYCLE NUMBER (y) | AIMED CRANK ANGLE ($\theta_0$) | CONTENTS OF OPERATION | LINE |
|---|---|---|---|---|
| LEVELING INSTRUCTION | — | $\theta_0 = \theta_k$ | TO MOVE HEALD SINGLY TO WARP CLOSING POSITION | 1 |
| PICK FINDING INSTRUCTION | x | $\theta_0 = 180$ (DEGREES) | TO MOVE HEALD SINGLY TO MAXIMUM SHEDDING POSITION | 2 |
| | x + 1 | $\theta$ | TO SYNCHRONIZE DRIVE MOTOR WITH CURRENT CRANK SHAFT & ROTATE CRANK SHAFT REVERSELY TO 180 DEGREES | 3 |
| | x | $\theta$ | TO ROTATE CRANK SHAFT TO 180 DEGREES & ESTABLISH SYNCHRONIZATION | 4 |
| STARTING PREPARTING INSTRUCTION | x - 1 | $\theta_0 = \theta_s$ | TO MOVE HEALD SINGLY TO SHEDDING POSITION CORRESPONDING TO $\theta_0 = \theta_s$ (& ROTATE CRANK SHAFT SINGLY TO $\theta = \theta_s$) | 5 |
| | x | $\theta$ | TO SYNCHRONIZE DRIVE MOTOR WITH CRANK SHAFT REVERSELY TO $\theta = \theta_s$ | 6 |
| | x - 1 | $\theta$ | TO ROTATE CRANK SHAFT TO $\theta = \theta_s$ & ESTABLISH SYNCRONIZATION | 7 |
| AUTOMATIC SYNTHESIZATION INSTRUCTION | x | $\theta$ | TO MOVE HEALD TO SHEDDING POSITION CORRESPONDING TO CURRENT CRANK ANGLE | 8 |

PICK FINDING APPARATUS FOR ELECTRIC MOTOR DRIVEN HEALD FRAMES

BACKGROUND OF THE INVENTION

1. Field of the Invention

This invention relates to a shedding controlling apparatus for a loom for automatically performing a pick finding operation or the like during stopping of the loom wherein each of a plurality of heald frames is driven by a drive motor for the exclusive use without utilizing a crank shaft of the loom as a driving source therefor.

2. Description of the Related Art

A method and an apparatus for a loom wherein each of a plurality of heald frames is driven by a drive motor for the exclusive use without utilizing a crank shaft of the loom as a driving source therefor are already known and disclosed, for example, in Japanese Patent Publication Application No. 63-58940.

Employment of a motor for the exclusive use for driving each of a plurality of heald frames provides an advantage that exchange of mechanical parts such as a cam is not required upon changing of a textile weave or of a shedding pattern (which is shedding stroke pattern of a heald frame in one cycle of a loom, which applies also to the following description) according to a type of a yarn or the like.

Meanwhile, a loom is stopped immediately when, for example, weft insertion fails as seen in FIG. 5. Next, various operations such as a leveling operation (operation of arranging all heald frames to a weft closing position in order to minimize elongation of wefts during stopping of the loom), a pick finding operation (operation of moving a heald frame to a maximum shedding position of a preceding cycle in order to pick up an end of a failed weft into a weft shedding), a starting preparing operation (operation of moving, after removal of the failed weft, the heald frame to a shedding position corresponding to a predetermined starting crank angle of a further preceding cycle) may be required.

With such conventional method and apparatus, during operation of the loom, the amount of rotation of the drive motor is controlled in accordance with a predetermined shedding pattern with respect to a crank angle, and accordingly, a heald frame can be driven maintaining a synchronized relationship with the crank shaft of the loom. So, if a failure in weft insertion occurs and the loom is stopped, then a pick finding operation and so forth can be performed by rotating the crank shaft of the loom reversely. However, by the synchronization between the drive motor and the crank shaft of the loom, a beating operation will be performed during such a pick finding operation, which will cause a weft bar to be produced on a woven fabric, which is not preferable. Thus, in order to eliminate this, it is necessary to cut the synchronized relationship between the drive motor and the crank shaft of the loom and cause only the drive motor to be driven. In this instance, however, upon subsequent re-starting of the loom, an operation for establishing a synchronized relationship between them is required, which, however, is very complicated and cumbersome. Further, if power supply interruption or the like occurs during operation of the loom, and since the amount of inertial rotation is different between the crank shaft of the loom and the drive motor, the synchronized relationship between them cannot be maintained, and consequently, an operation for synchronization is necessary similarly as described above. Particularly, in this instance, since such operation of synchronization is necessary for all looms in the plant, the burden in labor is very heavy.

Further, since a leveling operation, a pick finding operation and a starting preparing operation must individually be performed manually, also there is a problem that operation of the loom is very complicated and requires a high degree of skill.

SUMMARY OF THE INVENTION

It is an object of the present invention to provide a shedding controlling apparatus for a loom by which, where each of a plurality of heald frames of the loom is driven by a drive motor for the exclusive use therefor, a necessary operation such as a pick finding operation as well as an automatic operation for synchronization of the drive motor with a crank shaft of the loom can be performed very readily.

In order to attain the object, according to the present invention, there is provided a shedding controlling apparatus for a loom wherein each of a plurality of heald frames is driven by a drive motor for the inclusive use therefor, comprising shedding pattern designating means for storing shedding patterns of the heald frame therein and for specifying and outputting one of the shedding patterns for each operation cycle of the loom, position instructing means for defining an aimed amount of rotation of the drive motor in accordance with the shedding pattern from the shedding pattern designating means and a crank angle of a main shaft of the loom, position controlling means for controlling rotation of the drive motor in accordance with the aimed amount of rotation from the position instructing means, movement instructing means for driving the drive motor to rotate by a predetermined amount during stopping of the loom, and shedding instructing means for instructing the movement instructing means of a particular shedding pattern by way of the shedding pattern designating means in response to an operation instruction signal from the outside, wherein the movement instructing means determines an amount of rotation of the drive motor in accordance with the shedding pattern designated by the shedding instructing means in response to the operation instruction signal.

In the shedding controlling apparatus for a loom, the position controlling section can control, during operation of the loom, the amount of rotation of the drive motor such that it may follow up an aimed amount of rotation received from the position instructing means, and the aimed amount of rotation then follows a shedding pattern for each cycle from the shedding pattern designating means. Accordingly, the heald frame can operate in accordance with the predetermined shedding pattern in a synchronized relationship with the crank shaft of the loom.

On the other hand, when the loom is in a stopping condition, the shedding instructing means designates a particular shedding pattern to the movement instructing means in response to an operation instruction signal from the outside, and the movement instructing means determines an amount of rotation of the drive motor in accordance with the designated shedding pattern. Thus, when the operation instruction signal instructs automatic synchronization, the shedding pattern to be designated by the shedding instructing means is set to a shedding pattern in a cycle when a cause of the out-of-synchronization condition occurred, and the movement instructing means drives the drive motor using the shedding pattern so that it may assume a rotational position corresponding to the current crank angle of the crank shaft of the loom. On the other hand, when a pick finding instruction is received, that is, when the operation instruction signal instructs a pick finding operation, a shedding pattern of a cycle in which a failure in weft insertion occurred in used, and the drive motor is driven to a rotational position corresponding to 180 degrees at which the heald frame assumes its maximum shedding position. In the meantime, when a starting preparing instruction is received, a shedding pattern cycle turning back one-cycle in which a failure in weft insertion occurred is used, and the drive motor is driven to a rotational position corresponding to a predetermined starting crank angle. Thus, even if the shedding pattern is different for each cycle of the loom, the movement instructing means drives the drive motor in accordance with contents of the operation instruction signal so that it may assume a rotational position corresponding to a predetermined aimed crank angle in a shedding pattern corresponding to a predetermined cycle to drive the heald frame to a predetermined shedding position.

It is to be noted that, when the operation instruction signal is a pick finding instruction or a starting preparing instruction, alternatively the crank shaft of the loom may be driven to an aimed crank angle after the drive motor is synchronized with the current crank angle of the loom, that is, after the drive motor is driven using a shedding pattern of a cycle in which a failure in weft insertion occurred so that it may assume a rotational angle corresponding to the current crank angle, or otherwise the drive motor may be synchronized with the crank shaft of the loom after the crank shaft of the loom is driven to an aimed crank angle. In other words, after the crank shaft of the loom is driven to an aimed crank angle, the drive motor will be driven to a rotational position corresponding to the aimed crank angle using a shedding pattern of a cycle in which a failure in weft insertion occurred. In those instances, the aimed crank angle generator should output an aimed crank angle not to the movement instructing means but to a crank angle controlling system provided for controlling the crank shaft of the loom.

Thus, with the shedding controlling apparatus for a loom, since the movement instructing means and the shedding instructing means can control the drive motor so that, when necessary, it can perform, in addition to an operation for establishing a synchronized relationship thereof with the crank shaft of the loom, a series of operations including a leveling operation, a pick finding operation and a starting preparing operation. Accordingly, the shedding controlling apparatus for a loom according to the present invention is advantageous in that operation of the loom is simplified significantly.

The above and other objects, features and advantages of the present invention will become apparent from the following description and the appended claims, taken in conjunction with the accompanying drawings in which like parts or elements are denoted by like reference characters.

BRIEF DESCRIPTION OF THE DRAWINGS

FIG. 4 is a table showing details of operation of the shedding controlling apparatus of FIG. 1.

DETAILED DESCRIPTION OF THE PREFERRED EMBODIMENT

Figure 1:
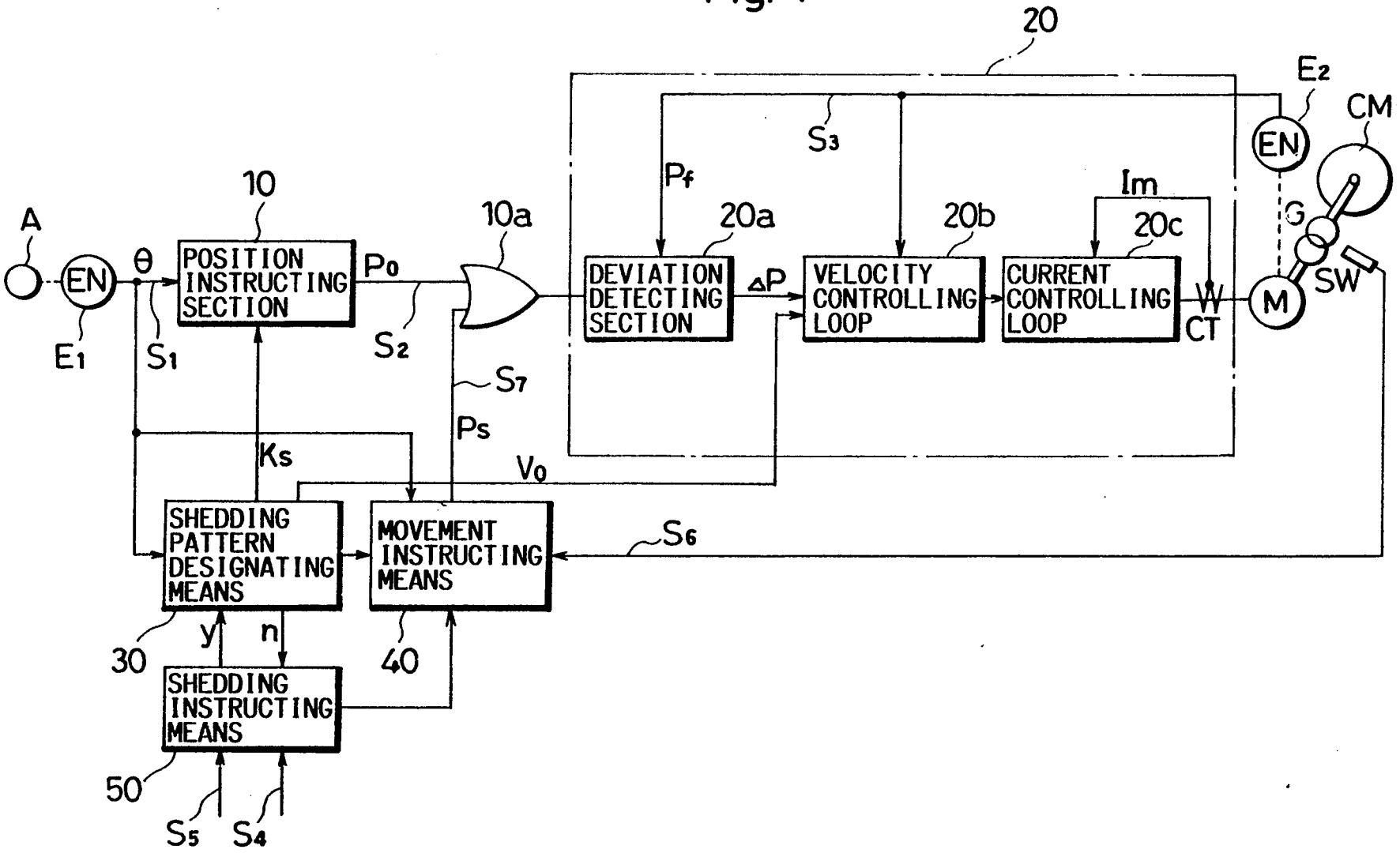
FIG. 1 is a block diagram of movement instructing means, shedding pattern designating means and a shedding controlling apparatus for a loom according to the present invention.

Referring first to FIG. 1, there is shown a shedding controlling apparatus for a loom to which the present invention is applied. The shedding controlling apparatus includes a position instructing section 10, a position controlling section 20, shedding pattern designating means 30, movement instructing means 40 and shedding instructing means 50.

A pulse train signal $S_1$ indicative of a crank angle $\theta$ is inputted to the position instructing section 10 from an encoder $E_1$ connected to a crank shaft A of a loom (not shown). An output of the position instructing section 10 is inputted as a pulse train signal $S_2$ indicative of an aimed amount $P_0$ of rotation of a drive motor M of the loom to a deviation detecting section 20*a* of the position controlling section 20 by way of an OR gate 10*a*.

The position controlling section 20 includes the deviation detecting section 20*a*, a velocity controlling loop 20*b* and a current controlling loop 20*c* connected in cascade connection, and an output of the position controlling section 20 is coupled to the drive motor M. An amount Pf of rotation of the drive motor M is detected by another encoder $E_2$ and fed back as a pulse train signal $S_3$ to the deviation detecting section 20*a* and the velocity controlling loop 20*b*. Such pulse train signal $S_3$, however, is used, in the velocity controlling loop 20*b*, as a signal having a pulse frequency which indicates a velocity of rotation of the drive motor M. An electric current Im of the drive motor M is fed back to the current controlling loop 20*c* by way of a current detector CT interposed between the current controlling loop 20*c* and the drive motor M.

The drive motor M is connected to a cam mechanism CM by way of a gear mechanism G. The cam mechanism CM is used to drive a heald frame (not shown) of the loom. It is to be noted that, while normally a plurality of heald frames are used in combination in such a loom, here only those elements which are associated with one of such heald frames are shown in FIG. 1.

The crank angle $\theta$ from the encoder $E_1$ is also inputted to the shedding pattern designating means 30 and the movement instructing means 40. Meanwhile, a loom stopping signal $S_4$ and an operation instructing signal $S_5$ from a loom controlling circuit (not shown) are inputted to the shedding instructing means 50 while an origin signal $S_6$ is inputted to the movement instructing means 40. Such loom stopping signal $S_4$ may be generated upon occurrence of a cause for stopping of the loom such as, for example, a failure in weft insertion and also upon interruption of power supply by making use of an output of a low voltage relay interposed in a power supply line for a main motor (not shown). Meanwhile, the operation instructing signal $S_5$ indicates a timing at which the movement instructing means 40 is to be rendered operative, and the origin signal $S_6$ is outputted from an origin detecting switch SW incorporated in a driving system of the drive motor M and indicates an origin position of one of the heald frames which is driven by the drive motor M.

The shedding pattern designating means 30 outputs, for each cycle of the loom, a shedding pattern Ks and a base velocity $V_0$ of the drive motor M to the position instructing section 10 and the velocity controlling loop 20*b* of the position controlling section 20, respectively. Here, the shedding pattern Ks indicates a shedding stoke of the heald frame and hence a pattern of the amount of rotation which the drive motor M has moved by the shedding pattern Ks with respect to a crank angle $\theta$ at a particular cycle in one repeat constituted from a plurality of cycles in accordance with a weave pattern of a fabric being woven. And, the base velocity $V_0$ indicates a period and a speed over and at which the drive motor M should rotate with respect to a crank angle $\theta$ while the heald frame is driven in accordance with the shedding pattern Ks.

The shedding pattern designating means 30 and the shedding instructing means 50 are connected in a bidirectional condition, and outputs of them are individually coupled to the movement instructing means 40. A movement adjusting signal $S_7$ is outputted from the movement instructing means 40 to the OR gate 10*a*. Such movement adjusting signal $S_7$ is a pulse train signal indicative of an adjusting amount Ps of the drive motor M.

Figure 2:
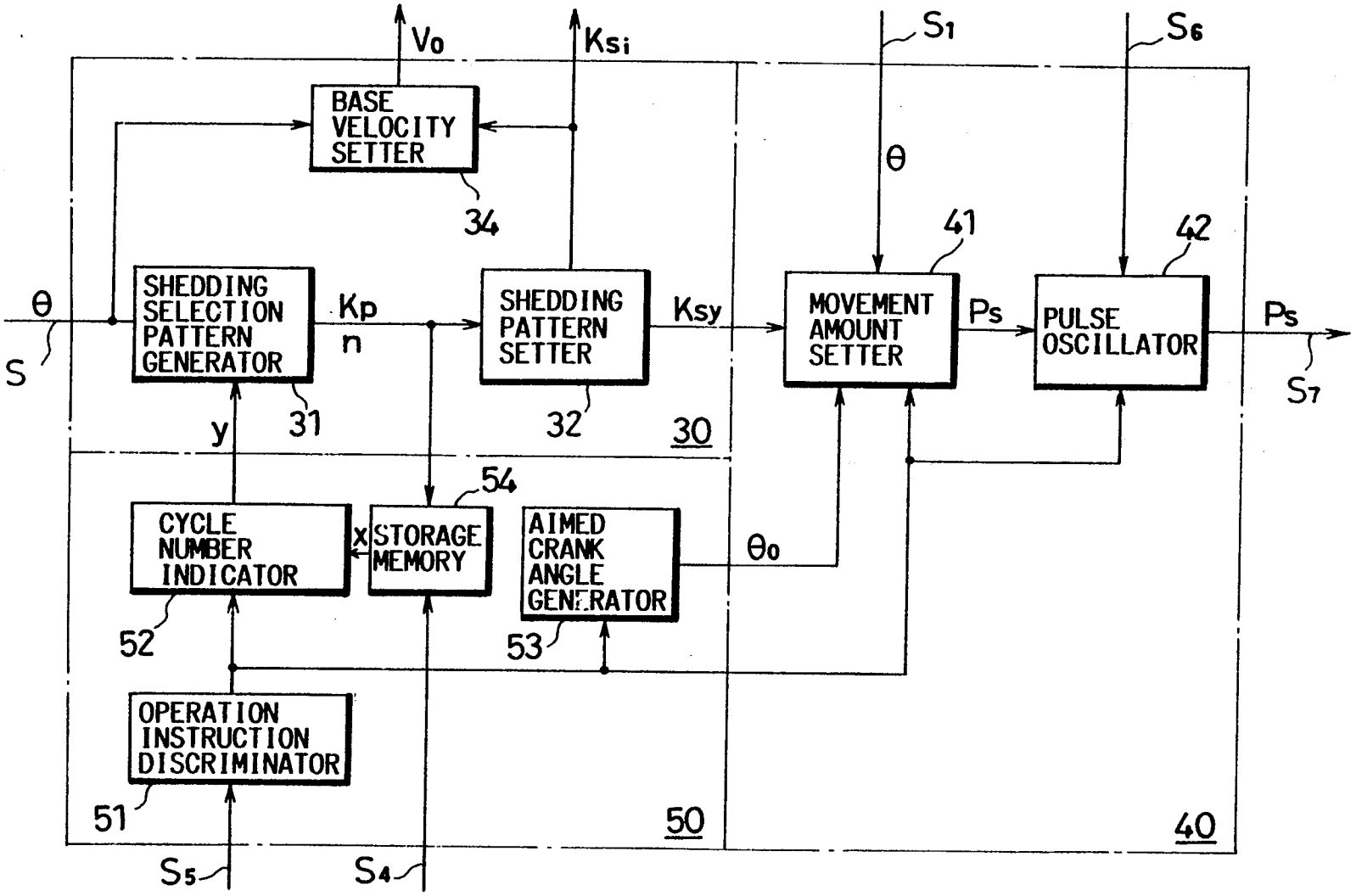
FIG. 2 is a block diagram showing details of movement instructing means shown in FIG. 1.

Referring now to FIG. 2, the shedding pattern designating means 30 includes a shedding selection pattern generator 31, a shedding pattern setter 32 and a base velocity setter 34.

The shedding selection pattern generator 31 stores therein shedding selection patterns (in order to indicate patterns of a heald frame for individual repeats corresponding to repeats of a weave pattern of a fabric woven, one repeat of a shedding pattern is divided into a plurality of cycles of shedding patterns, and each divided cycle of a shedding pattern is ordered corresponding to a shedding pattern number (hereinafter referred to as shedding selection pattern number Kp)). The shedding selection pattern generator 31 receives a signal $S_1$ which is a crank angle of a main shaft of the loom, and outputs a cycle number n and a shedding selection pattern number Kp as a cycle position and shedding pattern Ks of a shedding frame to achieve a weaving pattern of a fabric woven. Such outputs of the shedding selection pattern generator 31 are coupled to the shedding pattern setter 32 and a storage memory 54 of the shedding instructing means 50.

The shedding pattern setter 32 is provided to set shedding patterns Ksi ($i=1, 2, \ldots$) of the heald frame for each one cycle of the loom. Since the shedding pattern Ks of the heald frame must be varied for each shedding selection pattern number Kp, a plurality of different shedding patterns Ksi are set and stored in the shedding pattern setter 32.

A shedding pattern Ksi from the shedding pattern setter 32 is outputted to the position instructing section 10. Further, another output of the shedding pattern setter 32 is connected to a movement amount setter 41 of the movement instructing means 40.

A base velocity setter 34 is connected to the shedding pattern setter 32. A shedding pattern Ksi and a crank angle $\theta$ are inputted to the base velocity setter 34, and an output of the base velocity setter 34 is outputted as a base velocity $V_0$ to the velocity controlling loop 20*b* of the position controlling section 20.

The shedding instructing means 50 includes an operation instruction discriminator 51 to which an operation instructing signal $S_5$ is inputted, the storage memory 54 to which a loom stopping signal $S_4$ is inputted, a cycle number indicator 52 and an aimed crank angle generator 53. An output of the operation instruction discriminator 51 is connected to the shedding selection pattern generator 31 by way of the cycle number indicator 52 and also to the aimed crank angle generator 53 and the movement amount setter 41 and a pulse oscillator 42 of the movement instructing means 40. An output of the storage memory 54 is connected to the cycle number indicator 52, and an output of the aimed crank angle generator 53 is connected to the movement amount setter 41.

The movement instructing means 40 includes the movement amount setter 41 and the pulse oscillator 42 connected to each other, and a crank angle $\theta$ is inputted to the movement amount setter 41 while an origin signal $S_6$ is inputted to the pulse oscillator 42. An output of the pulse oscillator 42 is inputted as a movement adjusting signal $S_7$ to the OR gate 10*a* as seen in FIG. 1.

Figure 3:
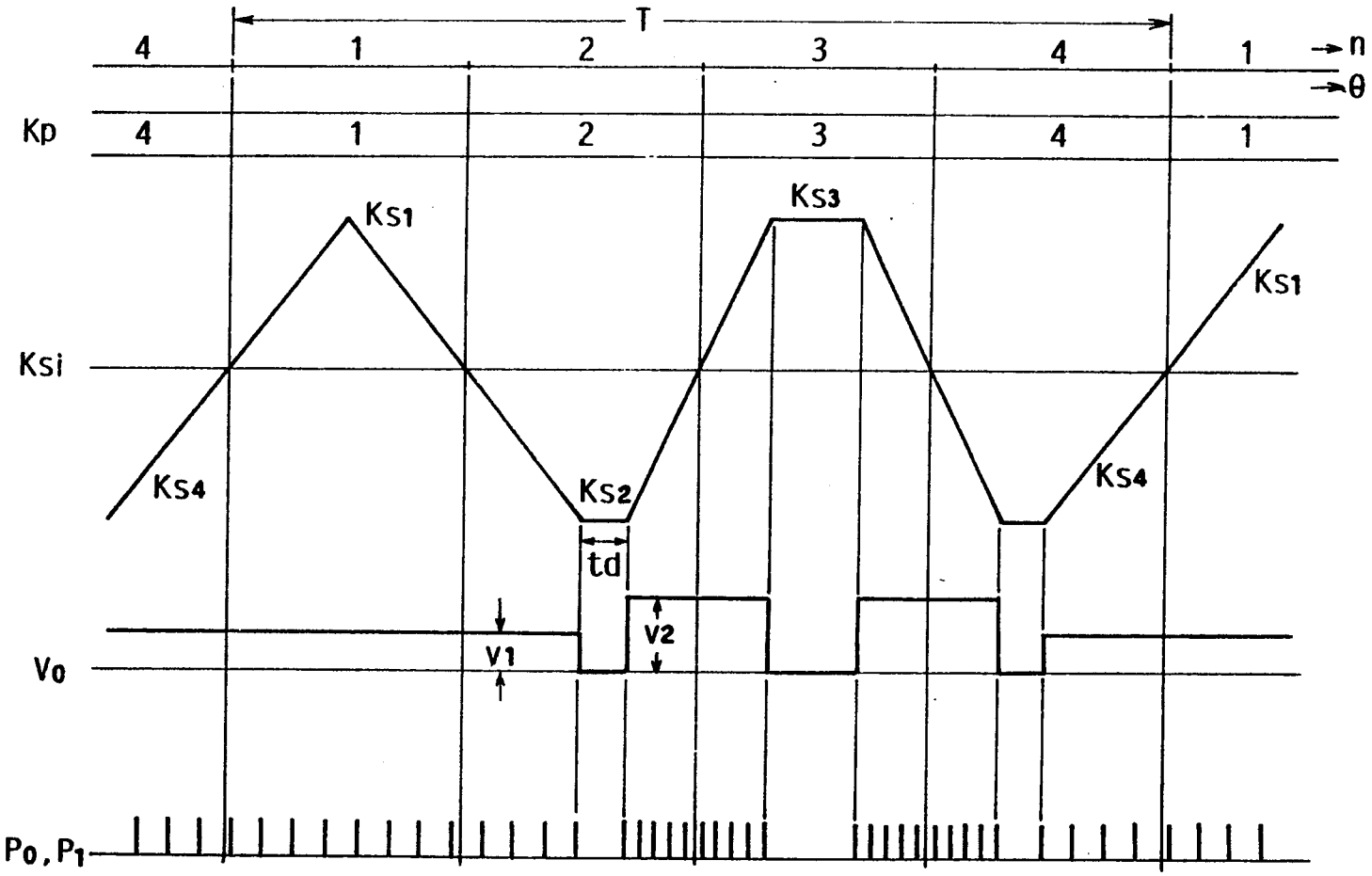
FIG. 3 is a diagram illustrating operation of the shedding controlling apparatus of FIG. 1.

Now, referring to FIGS. 1 and 2, if it is assumed that the loom is operating steadily, as the crank shaft A of the loom rotates, a pulse train signal $S_1$ indicative of a crank angle $\theta$ is outputted from the encoder $E_1$ and inputted to the shedding selection pattern generator 31 of the shedding pattern designating means 30. Thus, the shedding selection pattern generator 31 can specify, from the inputted crank angle $\theta$, a cycle number n ($n=1, 2, \ldots$) in one repeat T of a designated weave pattern as seen in FIG. 3 and output the cycle number n and a shedding selection pattern number Kp corresponding to the cycle number n. Since the shedding selection pattern number Kp is sent out to the shedding pattern setter 32, the shedding pattern setter 32 can select a particular shedding pattern Ksi indicated by the shedding selection pattern number Kp and send it out to the position instructing section 10 and the base velocity setter 34.

It is to be noted that a shedding selection pattern number Kp can repetitively indicate a same shedding pattern Ks for a plurality of cycles included in one repeat T so that it may be used. In this instance, $Kp \neq n$.

Meanwhile, when the crank shaft A of the loom rotates forwardly, the shedding selection pattern generator 31 increments the cycle number n by one for each one rotation of the crank shaft A of the loom, and when the cycle number n exceeds a cycle number which constitutes one repeat T, the cycle number n is reset to $n=1$. On the other hand, when the crank shaft A of the loom rotates reversely, the cycle number n is decremented one by one, and after it becomes equal to $n=0$, it is reset to the cycle number which constitutes one repeat T.

The position instructing section 10 can refer to the crank angle $\theta$ from the encoder $E_1$ and the shedding pattern Ksi from the shedding pattern designating section 30 to produce a pulse train signal $S_2$ indicative of an aimed amount $P_0$ of rotation. Here, such pulse train signal $S_2$ is a compression pulse train conforming to an aimed amount $P_0$ of rotation such that it presents dense pulses upon high speed rotation of the drive motor M but presents non-dense pulses upon low speed rotation of the drive motor M, and no such pulse is generated during stopping of the loom. For example, referring to FIG. 3, a shedding pattern Ksi designated by the cycle of $n=2$ among 4 cycles which constitute one repeat T of a weave pattern is $Ksi=Ks_2$. In this instance, the drive motor M is driven, at an initial stage of the cycle, equally at a low speed $V_1$ continuously from the cycle of $n=1$, and after that, the drive motor M is stopped. Then, after lapse of a dwell period $t_d$, the drive motor M is started in the latter half of the cycle and driven equally at a high speed $v_2$ until it continues to the next cycle of $n=3$.

Meanwhile, the base velocity setter 34 refers to the shedding pattern Ksi and the current crank angle $\theta$ and outputs a base velocity $V_0$ to the velocity controlling loop 20*b* of the position controlling section 20. However, the base velocity $V_0$ is a signal which exhibits the fixed values $v_1$ and $v_2$ ($v_1<v_2$) only for driving periods of the drive motor M provided by the shedding pattern Ksi.

The aimed amount $P_0$ of rotation of the position instructing means 10 is inputted to the deviation detecting section 20*a* (for example, that is composed of an up-down counter) of the position controlling section by way of the OR gate 10*a*. Meanwhile, since an amount Pf of rotation of the drive motor M is fed back to the deviation detecting section 20*a*, the deviation detecting section 20*a* can calculate and output a deviation $\Delta P=P_0-Pf$ of the amount Pf of rotation from the aimed amount $P_0$ of rotation.

Since such deviation $\Delta P$ is inputted to the velocity controlling loop 20*b*, the drive motor M is controlled so that it is driven by way of the velocity controlling loop 20*b* and the current controlling loop 20*c* in a direction in which the deviation $\Delta P$ is reduced to zero and the amount of rotation Pf thereof follows up the aimed amount $P_0$ of rotation. In other words, the position controlling section 20 can control the amount of rotation of the drive motor M from the origin position in accordance with the aimed amount $P_0$ of rotation. It is to be noted that, in this instance, the velocity of rotation of the drive motor M basically follows the base velocity $V_0$ from the base velocity setter 34 and besides the amount Pf of rotation follows up the predetermined shedding pattern Ksi in the cycle with respect to the crank angle $\theta$. It is to be noted here that the deviation detecting section 20*a* digitally calculates a deviation $\Delta P=P_0-Pf$ in order to handle pulse train signals $S_2$ and $S_3$, and the velocity controlling loop 20*b* and the current controlling loop 20*c* should preferably be each in the form of an analog controlling loop in order to handle such base velocity $V_0$ and current Im each in the form of an analog amount.

The drive motor M is driven to rotate in accordance with the aimed amount $P_0$ of rotation while the heald frame connected to the drive motor M can continue its shedding operation in accordance with the predetermined shedding pattern Ksi in such a manner as described above.

When an interruption of power supply occurs during steady operation of the loom, a loom stopping signal $S_4$ is generated from the loom controlling circuit. Since the loom stopping signal $S_4$ is inputted to the storage memory 54 of the shedding instructing means 50, the storage memory 54 can store, from an output of the shedding selection pattern generator 31 then, a cycle number $n=x$ of the cycle in which the interruption of power supply occurs. Further, in this instance, a deviation $\Delta P$ from the deviation detecting section 20*a* is compulsorily cleared so that the base velocity $V_0$ from the base velocity setter 34 is compulsorily held to the zero level. Accordingly, the position controlling section 20 stops its function. The drive motor M may be acted upon by a suitable brake mechanism in order to minimize its inertial rotation.

After stopping of the loom is completed in this manner, since generally the main motor for driving the crank shaft A of the loom and the drive motor M do not have equal amounts of inertial rotation, a synchronized relationship is not maintained between them, and accordingly, a synchronizing operation for them is required after recovery of power supply.

When power supply is recovered, the function of the position controlling section 20 is first recovered, and the loom controlling circuit generates an operation instruction signal $S_5$ for the instruction of automatic synchronization. In this instance, however, the base velocity setter 34 is left in a condition wherein it stops its function so that the base velocity $V_0$ is held at the zero level. Since such operation instruction signal $S_5$ is inputted to the operation instruction discriminator 51 of the shedding instructing means 50, the operation instruction discriminator 51 can discriminate that contents of the operation instruction signal $S_5$ are an instruction of automatic synchronization and thus send it out to the cycle number indicator 52, aimed crank angle generator 53, movement amount setter 41 and pulse oscillator 42. In this instance, however, the aimed crank angle generator 53 does not operate at all. In accordance with the inputting of the operation instruction signal $S_5$, the pulse oscillator 42 sends out a movement adjusting signal $S_7$ to the position controlling section 20 by way of the OR gate 10*a*, and consequently, the drive motor M starts to rotate at a low speed so that it may follow a pulse train of the movement adjusting signal $S_7$ and can generate an origin signal $S_6$ when it arrives at the origin position of the driving system.

In the meantime, since the cycle number $n=x$ of the cycle in which the interruption of power supply occurred is held in the storage memory 54, the cycle number indicator 52 reads out the cycle number x from the storage memory 54 and sends it out as an instruction cycle number $y=x$ to the shedding selection pattern generator 31. Consequently, the shedding selection pattern generator 31 outputs a shedding selection pattern number Kp to the shedding pattern setter 32, corresponding to the cycle number $n=y=x$.

Thus, the shedding pattern setter 32 selects a shedding pattern $Ksi=Ksx$ corresponding to the shedding selection pattern number Kp and outputs it to the movement amount setter 41. The movement amount setter 41 can thus refer to the shedding pattern Ksx and the current crank angle $\theta$ to determine a rotational position the drive motor M should assume in accordance with fitting to the correct crank angle $\theta$ from the origin position and can output an appropriate amount of rotation as a movement adjusting amount Ps to the pulse oscillator 42. In this instance, the movement adjusting amount Ps is defined as an amount of rotation of the drive motor M from its origin position.

The pulse oscillator 42 continues to output the movement adjusting signal $S_7$ also after the origin signal $S_6$ is received. In this instance, if it is assumed that the pulse oscillator 42 outputs as a movement adjusting signal $S_7$ after generation of the origin signal $S_6$ a signal of a train of a number of pulses corresponding to the movement adjusting amount Ps, then the drive motor M rotates, after generation of the origin signal $S_6$, by an amount corresponding to the movement adjusting amount Ps and then stops. In other words, the drive motor M can be driven or adjusted to a rotational position thereof corresponding accurately to the current crank angle $\theta$ in accordance with the shedding pattern Ksy and hence can be synchronized with the crank shaft A of the loom. Further, the movement instructing means 40 then determines an amount of rotation of the drive motor M using the current crank angle $\theta$ as an aimed crank angle in accordance with the designated shedding pattern Ksx.

In the meantime, since the shedding pattern Ksi=Ksy=Ksx is outputted from the shedding pattern setter 32 to the position instructing section 10, if the main motor is thereafter started in order to rotate the crank shaft A of the loom, then the drive motor M will follow the crank shaft A of the loom to drive the heald frame in such a manner as to continue to the shedding pattern Ksx before occurrence of the interruption of power supply. Accordingly, the crank shaft A of the loom can be moved to an arbitrary starting crank angle $\theta s$, from which the loom will be re-started. It is to be noted that the base velocity setter 34 recovers its function simultaneously with starting of the loom.

The reason why the cycle number n=x of the cycle in which the interruption of power supply occurred and the corresponding shedding pattern Ksi=Ksx are referred to when the drive motor M is to be synchronized with the crank shaft A of the loom in the description so far is that it is intended to establish a fully continuous condition of the weave pattern of the fabric being woven before and after the interruption of power supply. However, since it is not known at the cycle number x whether or not weft insertion has been completed, in case weft insertion has been completed, it is preferable to remove, after completion of a synchronizing operation, the failed weft from a cloth fell, rotate the crank shaft A of the loom reversely for one rotation and then start the loom. This is because weft insertion at the cycle number x may not possibly have been accomplished regularly due to occurrence of the interruption of power supply.

Figure 5:
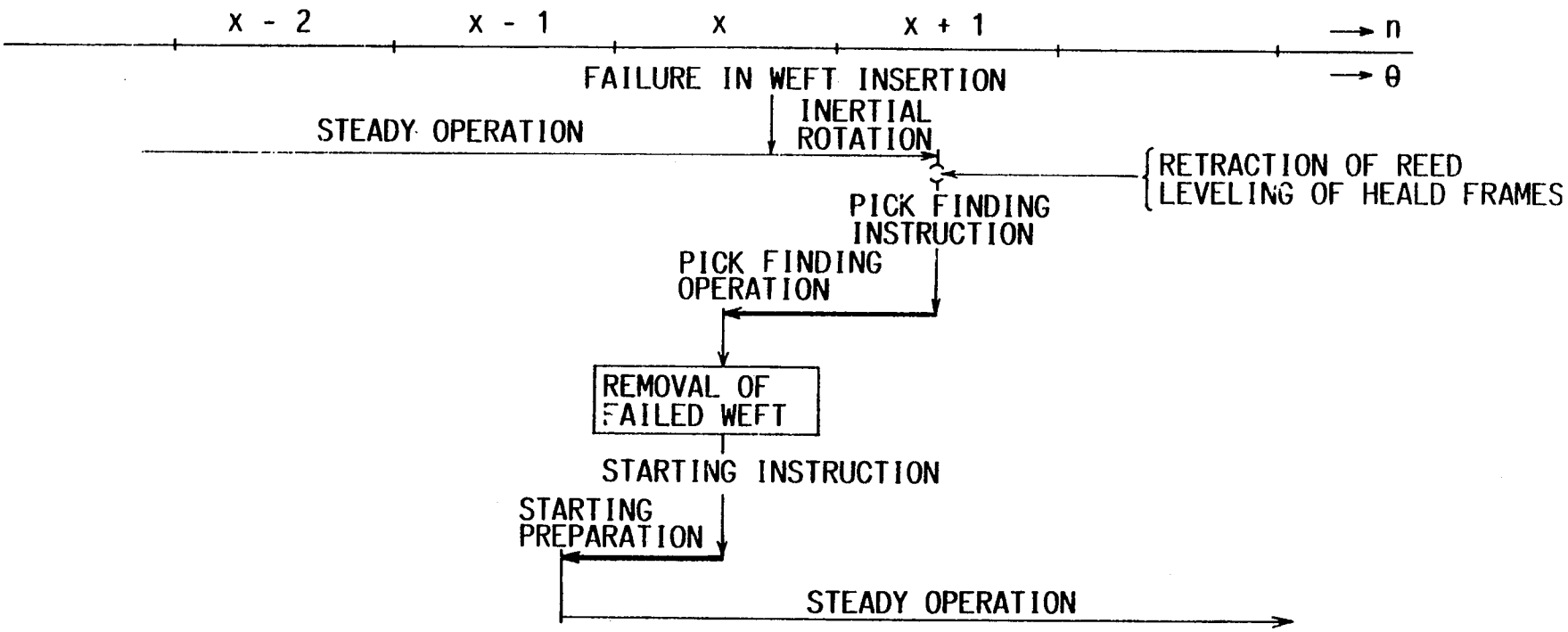
FIG. 5 is a diagram illustrating operational steps which may be taken when weft insertion fails.

If weft insertion fails at the cycle number n=x, then the loom is stopped at the cycle number n=x+1 after inertial operation of about 1 cycle without a weft insertion as seen from FIG. 5. Until the loom is re-started after then, a heald frame makes several operations including a leveling operation immediately after stopping of the loom, a pick finding operation responsive to a pick finding instruction, and a starting preparing operation responsive to a starting instruction after removal of a failed weft. However, the leveling operation can be omitted in case removal of a failed weft is performed automatically and a rest time of the loom is very short. This is because an amount of elongation of warps during stopping of the loom is considered to be small.

When an operation instruction signal $S_5$ for the instruction of a leveling operation is outputted from the loom controlling circuit, the operation instruction discriminator 51 sends out such instruction to the cycle number indicator 52, aimed crank angle generator 53, movement amount setter 41 and pulse oscillator 42. In this instance, the cycle number n=x of the cycle in which a failure in weft insertion occurred is held in the storage memory 54 because a loom stopping signal $S_4$ was inputted at a point of time when the failure in weft insertion occurred.

The aimed crank angle generator 53 generates, when it receives the leveling instruction from the operation instruction discriminator 51, an aimed crank angle $\theta_0=\theta k$ and outputs it to the movement amount setter 41. Here, $\theta k$ is a crank angle at which the heald frame assumes its warp closing position, and generally is $\theta k \approx 300$ degrees or so.

On the other hand, the cycle number indicator 52, shedding selection pattern generator 31 and shedding pattern setter 32 can determine a shedding pattern Ksi=Ksx corresponding to the cycle number n=y=x and output it to the movement amount setter 41 in a similar manner as in the case of operation in response to an instruction for the automatic synchronization described hereinabove. Thus, the movement amount setter 41 can calculate a movement adjusting amount Ps in accordance with the shedding pattern Ksx and the aimed crank angle $\theta_0=\theta K$ and the drive motor M by way of he pulse oscillator 42. Consequently, the drive motor M can drive the heald frame to a shedding position at the crank angle $\theta=\theta k$ of the shedding pattern Ksx, and accordingly, the heald frame can assume its warp closing position.

It is to be noted that the movement amount setter 41 need not necessarily refer to the aimed crank angle $\theta_0=\theta k$.

In particular, if the cycle number indicator 52 outputs to the shedding selection generator 31, in place of the instruction cycle number y=x, another instruction cycle number y=x+1 in accordance with the cycle number x stored in the storage memory 54, then the shedding pattern setter 32 can receive a shedding selection pattern number Kp and can output a shedding pattern Ksy=Ks(x+1) to the movement amount setter 41. Thus, the movement amount setter 41 can determine, referring to the shedding pattern Ks(x+1) upon perfect-stopping of the loom and the current crank angle $\theta$, a value X of the shedding pattern Ks(x+1) corresponding to the crank angle $\theta$ and determine a movement adjusting amount Ps such that the drive motor M may be driven to its warp closing position. This can effectively cope even with a case wherein the heald frame does not assume its warp closing position at the crank angle $\theta=\theta k$.

A heald frame commonly assumes its warp closing position at a particular rotational position of the drive motor M. Thus, the movement amount setter 41 may otherwise drive the drive motor M such that it is first driven in an arbitrary direction in response to a leveling instruction until the origin position not shown thereof is detected and then it is driven to a particular rotational position thereof at which the heald frame assumes its warp closing position. In this instance, the movement amount setter 41 need not refer to the shedding pattern Ksy at all, and the movement adjusting amount Ps corresponds to an amount of rotation necessary for the drive motor M to rotate to a predetermined particular position after it passes its origin position.

It is to be noted that, in case a reed is driven to its maximum retracted position by way of the crank shaft A of the loom immediately before a leveling operation, the function of the position instructing section 10 is formerly stopped in response to the operation instruction signal $S_5$ to cancel the follow-up control of the drive motor M to the crank shaft A of the loom.

A pick finding instruction is outputted in response to a manual switch by an operator or is outputted automatically from the loom controlling circuit and is transmitted in either case as an operation instruction signal $S_5$ to the operation instruction discriminator 51.

When it is outputted from the operation instruction discriminator 51 that the operation instruction signal $S_5$ is a pick finding instruction, the cycle number indicator 52 outputs an instruction cycle number $y=x$ while the aimed crank angle generator 53 outputs an aimed crank angle $\theta_0=180$ degrees. Thus, since the movement amount setter 41 receives a shedding pattern Ksx corresponding to the cycle number $n=x$ at which a failure in weft insertion occurred and the aimed crank angle $\theta_0=180$ degrees similarly as in the case described hereinabove, it may determine a movement adjusting amount Ps in accordance with the received information and drive the drive motor M by way of the pulse oscillator 42 in accordance with the thus determined movement adjusting amount Ps. The final stopping position of the heald frame by the drive motor M thus coincides with the maximum shedding position of the shedding pattern Ksx, and accordingly, a pick finding operation for the failed weft can be performed.

If a starting instruction is outputted by manual operation of an operator or is outputted automatically from the loom controlling circuit, then an operation instruction signal $S_5$ having the contents of an instruction for the starting preparation is provided to the operation instruction discriminator 51.

In this instance, the cycle number indicator 52 outputs an instruction cycle number $y=x-1$ while the aimed crank angle generator 53 outputs an aimed crank angle $\theta_0=\theta s$, where $\theta s$ is a predetermined starting crank angle. The movement amount setter 41 determines a movement adjusting amount Ps for the drive motor M in accordance with the instruction cycle number $y=x-1$, a shedding pattern $Ksy=Ks(x-1)$ received from the shedding pattern setter 32 by way of the shedding selection pattern generator 31 and the aimed crank angle $\theta_0=\theta s$. Consequently, the drive motor M can drive the heald frame finally to a shedding position corresponding to the crank angle $\theta=\theta s$ of the shedding pattern Ksx $-1$. Thus, if the crank shaft A of the loom is driven to the crank angle $\theta=\theta s$ and the functions of the position instructing section 10 and the position controlling section 20 are recovered to start the loom, then the drive motor M will thereafter follow up the crank shaft A of the loom. Consequently, a shedding operation continued to the shedding pattern $Ksx-1$ which was woven immediately before occurrence of a failure in weft insertion can be performed.

Here, since the drive motor M and the crank shaft A of the loom operate independently of each other in a starting preparing operation, they may alternatively be rendered operative in the reverse order or otherwise be rendered operative simultaneously.

It is to be noted that a pick finding operation and a starting preparing operation can be realized also by making use of an automatic synchronizing operation described hereinabove.

For example, a pick finding operation can be achieved if the drive motor M is automatically synchronized with the current crank shaft A of the loom and then the crank shaft A of the loom is rotated reversely about one rotation while maintaining the synchronized relationship (while working the position instructing section 10) until it is stopped at the position of the crank angle $\theta=180$ degrees at the cycle number $n=x$. In particular, the cycle number indicator 52 outputs an instruction cycle number $y=x+1$, and the movement amount setter 41 establishes synchronization of the drive motor M with the crank shaft A of the loom referring to the current crank angle $\theta$, after which the crank shaft A of the loom is rotated reversely about one rotation by way of the crank shaft controlling system not shown until the crank angle $\theta=180$ degrees is reached. It is to be noted that, in this instance, the aimed crank angle generator 53 must only output the aimed crank angle $\theta_0=180$ degrees to the crank shaft controlling system, and the crank shaft controlling system must only rotate the crank shaft A of the loom reversely making use of the aimed crank angle $\theta_0$.

Alternatively, the drive motor M may be synchronized with the crank shaft A of the loom depending on the shedding pattern Ksx after the crank shaft A of the loom has been driven by itself to the crank angle $\theta=180$ degrees (refer to the fourth line in FIG. 4).

Such similarly applies to a starting preparing operation, and the drive motor M may be synchronized with the crank shaft A of the loom with the instruction cycle number set to $y=x$, whereafter the crank shaft A of the loom is rotated reversely to the crank angle $\theta=\theta s$ (sixth line in FIG. 4), or alternatively, the drive motor M may be synchronized with the crank shaft A of the loom with the instruction cycle number set to $y=x-1$ after the crank shaft A of the loom is rotated by itself to the crank angle $\theta=\theta s$ (seventh line in FIG. 4).

It is to be noted that FIG. 4 illustrates the operations described above collectively, and the first line in FIG. 4 illustrates a leveling operation when an aimed crank angle $\theta_0=\theta k$ is referred to while the second line illustrates a pick finding operation when automatic synchronization is not utilized. Meanwhile, the third and fourth lines illustrate a pick finding operation when automatic synchronization is utilized. The fifth line illustrates a starting preparing operation when automatic synchronization is not utilized while the sixth and seventh lines illustrate a starting preparing operation when automatic synchronization is utilized. Further, the eighth line illustrates an automatic synchronizing operation itself.

When the loom is stopped due to break of a warp, the loom will wait with the heald frames set to a leveling condition when necessary, and after completion of recovery of the warp, the drive motor M will be automatically synchronized with the crank shaft A of the loom and then the loom will be started. Thus, the present invention can cope effectively with stopping of the loom due to break of a warp by performing a necessary operation in accordance with the contents of an operation instruction signal $S_5$.

It is to be noted that, when the loom is stopped due to a failure in weft insertion, the storage memory 54 may store therein, in place of a cycle number $n=x$ at which such failure in weft insertion occurs, another cycle number $n=x+1$ at which the loom stops, by changing the timing at which a loom stopping signal $S_4$ is to be generated. In this instance, the cycle number indicator 52 may make instruction cycle numbers $y=x$, $x+1$ and $x-1$ using the cycle number $x+1$ from the storage memory 54 in accordance with contents of an operation instruction signal $S_5$.

In the above explanation, it is shown to store a shedding pattern directly in the shedding pattern setter 32, also it is possible to store a rotation pattern of a drive motor instead of the above shedding pattern.

Having now fully described the invention, it will be apparent to one of ordinary skill in the art that many changes and modifications can be made thereto without departing from the spirit and scope of the invention as set forth herein.

What is claimed is:

1. A shedding controlling apparatus for a loom wherein each of a plurality of heald frames is driven by a drive motor for the inclusive use therefor, comprising shedding pattern designating means for storing shedding patterns of the heald frame therein and for specifying and outputting one of the shedding patterns for each operation cycle of said loom, position instructing means for defining an aimed amount of rotation of the drive motor in accordance with the shedding pattern from said shedding pattern designating means and a crank angle of a main shaft of said loom, position controlling means for controlling rotation of the drive motor in accordance with the aimed amount of rotation from said position instructing means, movement instructing means for driving the drive motor to rotate by a predetermined amount upon a stopping condition of said loom, and shedding instructing means for instructing said movement instructing means of a particulate shedding pattern by way of said shedding pattern designating means in response to an operation instruction signal from an external circuit, wherein said movement instructing means determines an amount of rotation of the drive motor in accordance with the shedding pattern designated by said shedding instructing means in response to the operation instruction signal.

2. A shedding controlling apparatus for a loom according to claim 1, wherein said shedding instructing means includes an aimed crank angle generator which outputs an aimed crank angle to said movement instructing means.

3. A shedding controlling apparatus for a loom according to claim 1, wherein said position instructing means is connected to said position controlling means by way of an OR gate, and an output of said position controlling means is connected to the drive motor.

4. A shedding controlling apparatus for a loom according to claim 3, wherein said position controlling means includes deviation detection means, a velocity controlling loop and a current controlling loop all connected in cascade connection, and an amount of rotation of the drive motor detected by an encoder connected to the drive motor is fed back as a pulse train signal to said deviation detecting means and said velocity controlling loop.

5. A shedding controlling apparatus for a loom according to claim 1, wherein said shedding pattern designating means includes a shedding selection pattern generator in which shedding selection patterns are stored and which outputs one of the shedding selection patterns together with a cycle number, and a shedding pattern setter for setting a shedding pattern of the heald frame for each one cycle of said loom.

6. A shedding controlling apparatus for a loom according to claim 1 or 2, wherein said shedding instructing means includes a storage memory for storing therein a cycle number when a loom stopping signal is generated, a cycle number indicator for reading the cycle number from said storage memory and outputting it to said shedding pattern designating means, and an operation instruction discriminator for discriminating an automatic synchronization instruction.

7. A shedding controlling apparatus for a loom according to claim 1, wherein said movement instructing means includes a pulse oscillator for outputting a movement adjusting signal to said position controlling means, and a movement amount setter for determining a rotational position of the drive motor and outputting an amount of rotation for the realization of such rotational position as a movement adjusting amount to said pulse oscillator.

* * * * *